United States Patent [19]

Fowler et al.

[11] 4,363,557

[45] Dec. 14, 1982

[54] MARKING DEVICE FOR SHORTHAND MACHINE

[75] Inventors: Paul J. Fowler, Glenview; Frank Chvojcsek, Chicago, both of Ill.

[73] Assignee: Stenograph Corporation, Skokie, Ill.

[21] Appl. No.: 257,777

[22] Filed: Apr. 27, 1981

Related U.S. Application Data

[63] Continuation of Ser. No. 148,461, May 9, 1980, abandoned, which is a continuation of Ser. No. 942,934, Sep. 18, 1978, abandoned.

[51] Int. Cl.[3] ..... B41J 3/26

[52] U.S. Cl. ..... 400/91; 400/20; 400/103; 400/391; 400/470; 400/580; 400/703; 400/706

[58] Field of Search ..... 400/20, 91, 92, 93, 400/94, 96, 103, 104, 105, 106, 107, 108, 390, 391, 393, 470, 471, 471.1, 580, 583.3, 703, 706; 101/368

[56] References Cited

U.S. PATENT DOCUMENTS

| | | | |
|---|---|---|---|
| 642,759 | 2/1900 | Schade | 400/393 |
| 1,283,198 | 10/1918 | Ireland | 400/94 |
| 1,433,453 | 10/1922 | Guerrero | 400/20 |
| 1,542,455 | 6/1925 | Howard | 400/91 |
| 1,559,771 | 11/1925 | Padman | 400/96 |
| 2,176,096 | 10/1939 | Oswald | 400/391 X |
| 2,199,265 | 4/1940 | Lohrey | 400/471.1 X |
| 2,319,273 | 5/1943 | Sterling | 400/93 |
| 2,424,073 | 7/1947 | Ayres | 400/580 |
| 2,449,126 | 9/1948 | Kirkpatrick | 400/93 |
| 2,745,532 | 5/1956 | Crawford, Jr. | 400/104 |
| 2,777,824 | 1/1957 | Leeds | 101/368 X |
| 2,823,784 | 2/1958 | Ambrose | 400/91 X |
| 2,847,104 | 8/1958 | Segui | 400/583.3 X |
| 3,055,297 | 9/1962 | Leeds | 400/470 X |
| 3,213,995 | 10/1965 | Applin | 400/91 X |
| 3,404,628 | 10/1968 | Lee | 400/103 X |
| 3,964,062 | 6/1976 | Flagg et al. | 400/94 X |
| 4,024,943 | 5/1977 | Steiner | 400/706 |
| 4,176,973 | 12/1979 | Gregory et al. | 400/91 |

*Primary Examiner*—Ernest T. Wright, Jr.
*Attorney, Agent, or Firm*—Lee, Smith & Jager

[57] ABSTRACT

A marking device for a shorthand machine selectively marks the margins of the paper tape output of the shorthand machine to denote a portion of the shorthand notes for ready reference. The activating keys for the device are located in close proximity with the machine keyboard, whereby the operator may activate the device with minimal interruption of the recording process. Disposable marking instruments may be employed in the device. Incorporation of the device in the machine cover preserves the first planar surface of the cover and further, facilitates storage of the device when not in use.

14 Claims, 8 Drawing Figures

MARKING DEVICE FOR SHORTHAND MACHINE

This is a continuation, of application Ser. No. 148,461, filed May 9, 1980, which in turn is a continuation of application Ser. No. 942,934, filed Sept. 18, 1978, both now abandoned.

BACKGROUND OF THE INVENTION

1. Field of the Invention

The invention is related to accessories for shorthand machines and is particularly directed to means for marking the margin of the shorthand paper tape of a shorthand machine for denoting portions of the notes for ready reference and recall.

2. Description of the Prior Art

Machine shorthand operators frequently desire to mark the paper tape output produced by the shorthand machine to denote a portion or portions of the notes recorded thereon for ready reference and quick retrieval of the information there encoded. In the past, this has been accomplished by merely marking the tape with a pen or pencil or slightly tearing the tape at its margin to indicate specific portions of the notes.

Removal of the operator's hands from the keyboard of the machine to perform this delineation of the notes interrupts the recording process, frequently causing the operator to play "catch-up" and thereby increasing the chances for error.

In addition to these known manual marking procedures, there are devices available which are physically attached to the cover plate of a shorthand machine by means of adhesive tape or the like. For example, it is known to provide an elongate bar which is adhesively secured to the removable cover of the shorthand machine, with one end of the bar projecting outwardly from the cover to a point above and in vertical alignment with the platen. A plunger is mounted on the bar and is spring-biased into an upward, retracted position. An ink-soaked sponge-like pad is mounted on the lower end of the plunger, and when the plunger is depressed, the pad strikes and marks the margin of the paper tape on the platen.

It is also known to provide a marking device having a hinged body, the lower half of which is adhesively mounted on the cover of the machine. A spring-wire member is mounted in the upper half of the body and defines two legs which project outwardly therefrom to a position above and in vertical alignment with the platen. A foam rubber pad is disposed between the hinged halves of the body for urging the upper half of the body and the wire member into a retracted position above the platen. The ends of the legs of the wire member hold a pair of inking pads mounted in plastic carriers which, when engaged and depressed, strike the paper tape on the platen of the machine.

Devices of this type interfere with the access of the platen, encumber the smooth surface of the machine cover with attachments, and as with a pen or pencil, require complete removal of the operator's hand from the machine keyboard in order to mark the paper tape. In addition, these devices require modification of the machine and/or removal of the cover in order to facilitate storage when not in use. Further, they require periodic re-inking.

SUMMARY OF THE INVENTION

The present invention is directed to a marking device for use in a shorthand machine wherein the device is located intermediate of the platen and keyboard of the machine in such a manner that it does not encumber the cover and does not interfere with access to the platen or the keyboard. The activating keys of the marking device extend longitudinally from a keyboard-adjacent end having a finger pad to a platen-adjacent end containing a marking instrument. The keys are slidable from a retracted position wherein the marking instruments are remote from the platen to an advanced position wherein the marking instrument strikes and marks the margins of the paper tape on the platen. Biasing means continuously urge the keys into the retracted position. The finger pads of the keys are located in close proximity with the keyboard, whereby the operator can engage and activate the device with minimum interruption of the recording process. The marking instruments comprise disposable elements which are readily discarded and replaced as they wear. The marking device is incorporated in the cover of the shorthand machine and therefore, preserves the smooth surface of the cover plate.

DESCRIPTION OF THE PREFERRED EMBODIMENT

Figure 1:
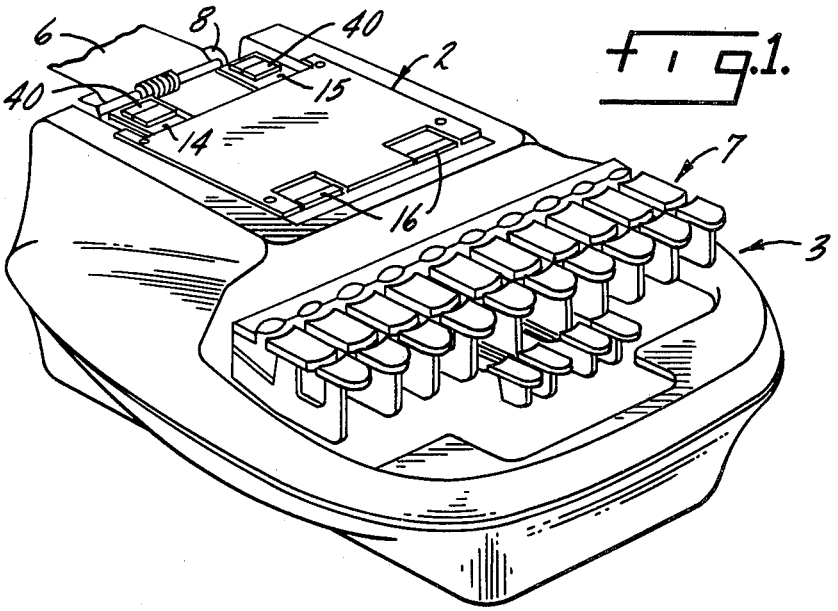
FIG. 1 is a perspective view of a shorthand machine and a marking device including the features of the present invention.
Figure 2:
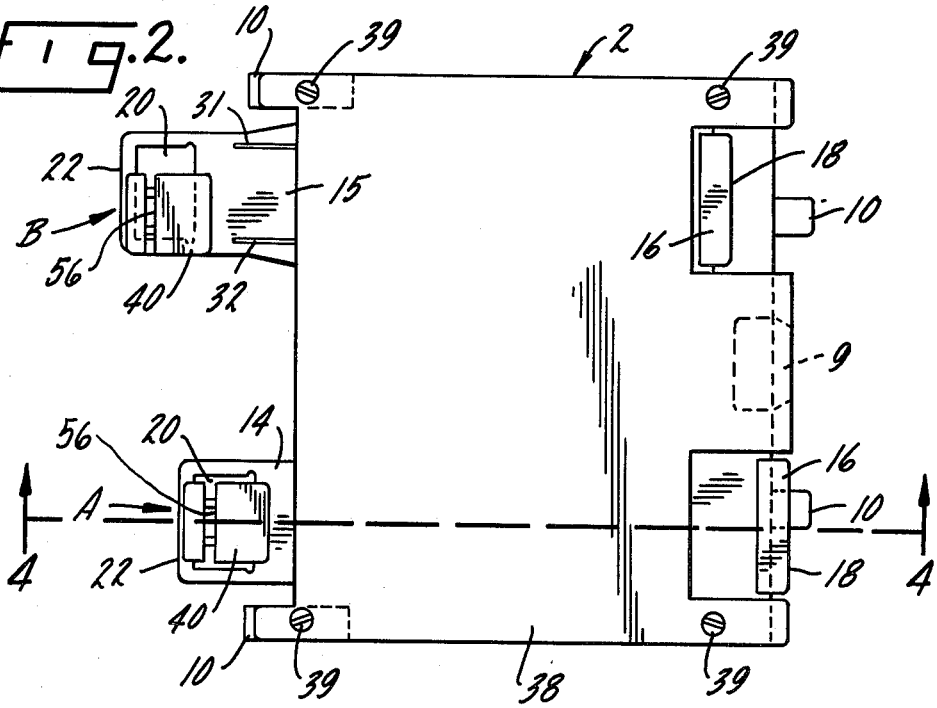
FIG. 2 is a top elevation view of the marking device illustrated in FIG. 1.

Referring to FIG. 1 of the drawing there is illustrated the marking device 2 of the present invention installed in a typical shorthand machine 3. A shorthand machine of this general type is more fully described in U.S. Pat. No. 2,319,273. Paper tape 6 is loaded in the machine 3 in the usual manner such that the paper tape 6 is carried and advanced by the platen 8 of the machine 3. Images are recorded on the tape 6 and the tape 6 is advanced around the platen 8 when the machine operator strikes the various keys of the keyboard 7 in the well known manner.

In the preferred embodiment, the housing or marking device 2 defines and therefore, replaces the typical removable cover of the shorthand machine 3. As can be seen in FIGS. 2, 3, 4, 5 and 8, the housing 2 comprises a substantially rectangular top plate 38 secured in spaced apart relationship to a complementary bottom or base plate 12 by screws 39 or other similar suitable bonding means. Tabs 10 depend from and project outwardly from the bottom side 11 of base plate 12 (FIG.

Figure 3:
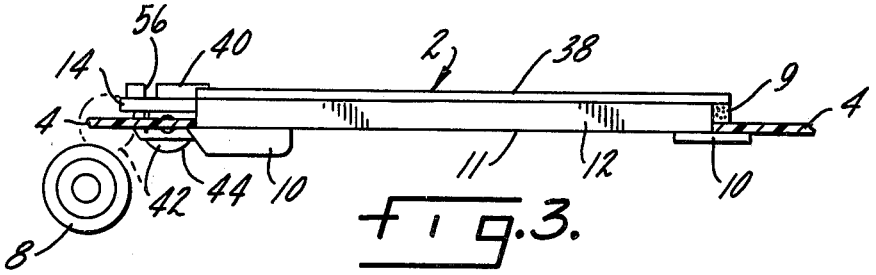
FIG. 3 is a diagrammatic illustration of a side view of the marking device illustrated in FIG. 1.

3), and engage the underside of the machine housing at 4 for securely mounting the marking device 2 in the machine 3. Pressure locking pad 9 made of resilient material such as rubber or the like is disposed between the top plate 38 and the bottom base plate 12 and engages the upperside of the machine housing 4, as shown in FIG. 3, securely holding the marking device 2 in the shorthand machine 3 and maintaining a proper relationship between the device 2 and the machine 3. Thus, the marking device 2 is in the position normally occupied by a typical cover of a shorthand machine and may be readily removed and replaced by the machine operator in a similar manner, providing ready access to the components of the machine 3. In addition, the smooth surface of the cover is preserved, permitting use of the cover as a writing surface and facilitating storage of the machine 3.

The housing 2 contains two elongate keys 14, 15 which are in horizontal, sliding relationship with the housing 2. It should be understood that only one elongate key 14 or 15 is needed to practice the invention, but two keys provide greater flexibility and usefulness. Each elongate key 14, 15 securely, though releasably, holds a marking instrument such as the disposable cartridge 40, which marks the paper tape 6.

The elongate keys 14, 15 rest in channels 60, 61, respectively, in the base plate 12. The channels 60, 61 extend the length of the base plate 12 from the keyboard-adjusting end 18 to the platen-adjacent end 22. Each elongate key 14, 15 slides in a longitudinal manner within the respective channel 60, 61, between a fully retracted position A and a fully advanced position B, as in FIG. 2.

Figure 4:
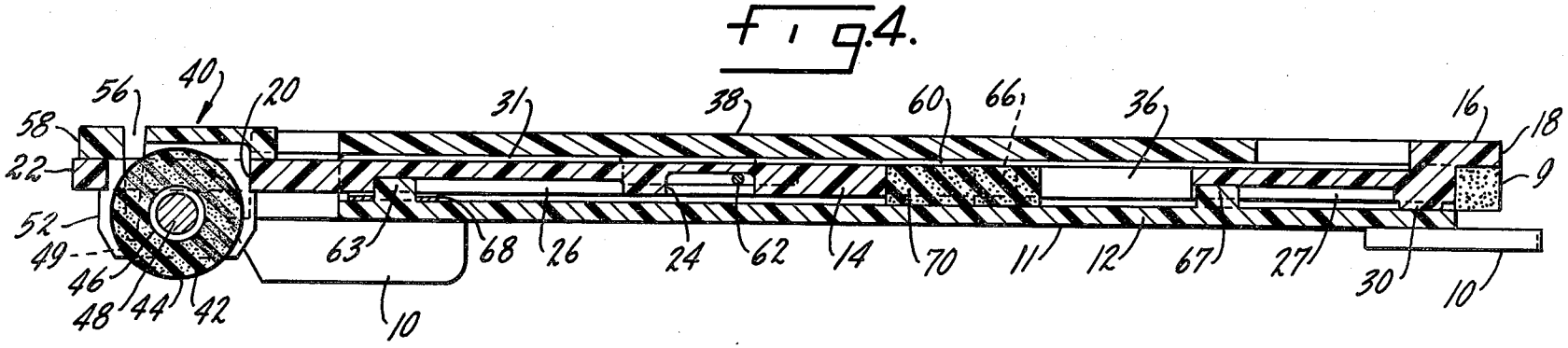
FIG. 4 is a cross-section taken at line 4—4 of FIG. 2.
Figure 5:
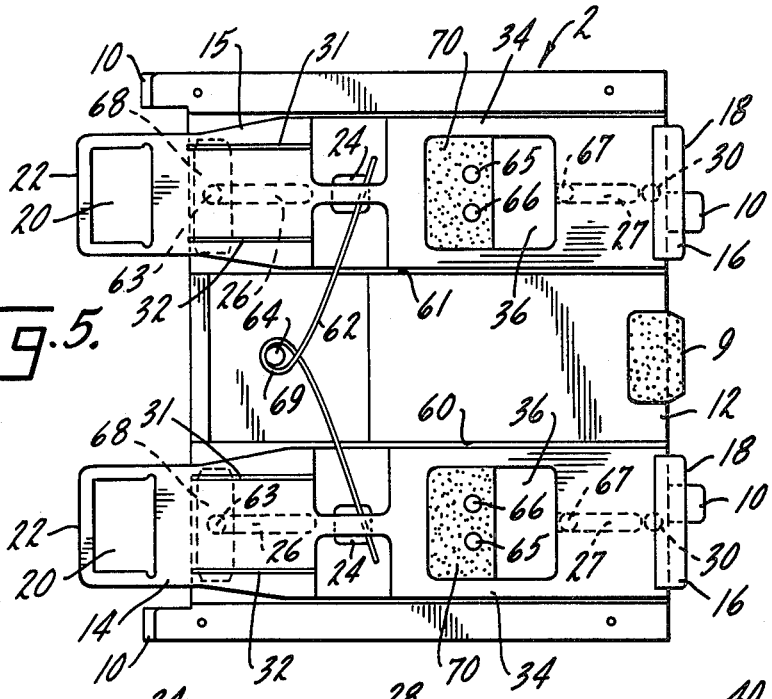
FIG. 5 is a top elevation view of the marking device with the cover and disposable marking instrument removed.
Figure 6:
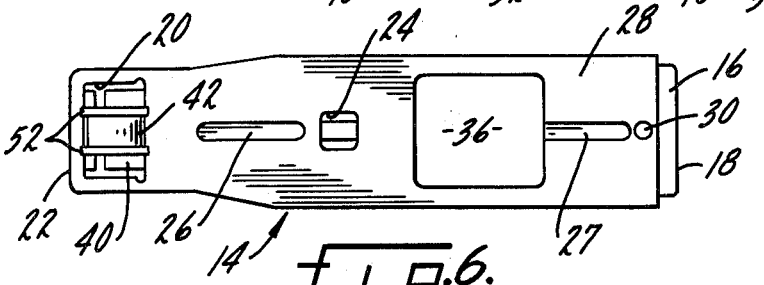
FIG. 6 is a bottom elevation view of an elongate key of the marking device, showing in detail a marking instrument including a disposable cartridge.

As best seen in FIGS. 4 and 5, two longitudinally spaced guideposts 63, 67 are positioned in each of the channels 60, 61 for tracking the keys 14, 15 and minimizing lateral movement thereof relative to the base plate 12. When the device 2 is assembled, the underside 28 of each elongate key 14, 15 faces the base plate 12, and the top side 34 of each key 14, 15 faces the top plate 38 of the housing 2. A depending contact 30, projects downwardly from the underside 28 of each elongate key 14, 15 near the keyboard-adjacent end 18 thereof. The contact 30 engages the respective channel 60, 61 of the base plate 12. The two longitudinal slots, 26, 27 in each elongate key 14, 15 receive the guideposts 63, 67 respectively.

Two ridges 31, 32 are formed on, project above and extend longitudinally along the top side 34 of each key 14, 15. When assembled, the ridges 31, 32 engage the underside of the cover plate 38 and establish contact between the keys 14, 15 and the cover plate 38 while maintaining low friction therebetween. To further maintain longitudinal and horizontal alignment of the keys 14, 15, each channel 60, 61 is provided with a lifter such as a "U"-shaped take-up spring 68. In the embodiment shown each take-up spring 68 is secured to the base plate 12 on post 63 near the platen-adjacent end of the respective channel 60, 61. The contact 30, spring 68 and ridges 31, 32 support the key 14, 15 in floating relationship within the housing 2 defined by top plate 38 and base plate 12.

An upstanding post 64 is located on the base plate 12 intermediate of the channels 60, 61. Biasing means such as torsion spring 62 is mounted on the base plate 12 by placing the coil 69 of the spring 62 on the post 64. The opposite ends of the torsion spring 62 are attached to slots or openings 24 provided in each key 14, 15 for continuously urging the keys 14, 15 into the fully retracted position A, see FIG. 2.

A dampening means consisting of a sponge rubber dampener 70 or the like is secured to each channel 60, 61 by two studs 65, 66 projecting upwardly from each channel 60, 61. Each of the studs 65, 66 secures a dampener 70 to the base plate 12 without limiting the compressibility of the dampener 70. Cavity 36 is located near the keyboard-adjacent end 18 of each key 14, 15, for receiving the dampener 70. The cavity 36 is longer than the dampener 70 and permits each key 14, 15 to be freely moved between the fully retracted and fully advanced positions. Upon retraction of the key 14, 15, the platen-adjacent end of the cavity 36 engages the dampener 70. Conversely, upon advancement of the key 14, 15, the keyboard-adjacent end of cavity 36 engages the dampener 70. Thus, each dampener 70 engages the respective key 14, 15 at the limits of its travel and acts as a positive stop while reducing the noise of operation by eliminating solid-to-solid contact.

Finger pads 16 are provided at the keyboard-adjacent end 18 of each key 14, 15 and thus are in close proximity with the keyboard 7 of the shorthand machine 3. Each elongate key 14, 15 is engaged by pressing the respective finger pad 16, which can be engaged by the operator without completely removing his or her hands from the keyboard 7. After selectively engaging one or both of the keys 14, 15, the operator need not reposition his or her hands in order to continue operation of the shorthand machine 3, thus saving time and enabling the operator to pay greater attention to the communication being recorded.

Figure 7:
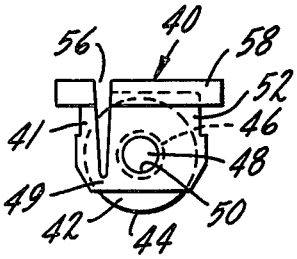
FIG. 7 is a side view of the disposable cartridge of FIG. 6.
Figure 8:
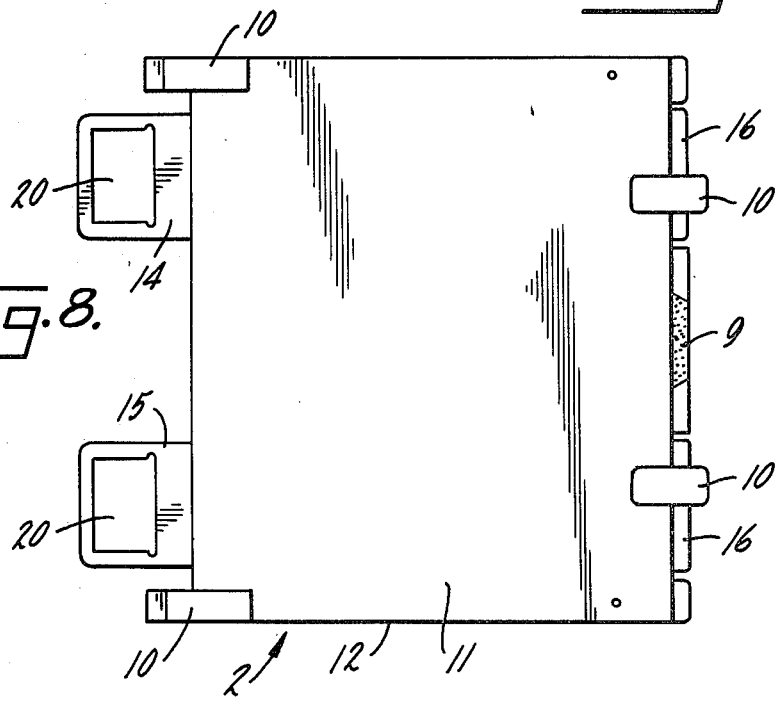
FIG. 8 is a bottom elevation view of the marking device, with the disposable cartridge removed.

Each elongate key 14, 15 has a forward cavity 20 near its platen-adjacent end 22. The forward cavity 20 receives the writing instrument of the device 2, such as disposable cartridge 40. The disposable cartridge 40 includes a "U"-shaped holder 41 having a top 58 and two sides 52. The top 58 of the holder 41 includes groove 56 which extends through each of the sides 52, as best shown in FIG. 7. The holder 41 and groove 56 define a live hinge 49 which enables the disposable cartridge 40 to be inserted in and ejected from the forward cavity 20 of the respective elongate key 14, 15. When the holder 41 is inserted in the cavity 20, the live hinge 49 is in compression and securely, though releasably, holds the disposable cartridge 40 in position in the forward cavity 20. The forward cavity 20 is wider than the disposable cartridge 40 so that the cartridge 40 may be laterally adjusted relative to the machine platen 8. Thus, the operator may adjust the disposable cartridge 40 to mark the paper tape 6 at different points across its width.

A roller 42 impregnated with ink 44 is rotatably mounted in the holder 41. In the preferred embodiment, sleeve 46 is securely fastened to the roller 42. The roller 42 and sleeve 46 are rotatably mounted on an axle 48 secured in the holder 41 through axle openings 50 provided in sides 52.

When the finger pad 16 of one or both of the elongate keys 14, 15 is engaged, the respective key 14, 15 is moved into the advance position B (FIG. 2) and the roller 42 of the disposable cartridge 40 strikes the paper tape 6. The roller 42 does not strike the underlying platen 8 squarely so that the roller 42 rotates upon striking. This insures that a different portion of the roller 42 strikes the paper 6 each time the device 2 is used and thereby extends the life of the disposable cartridge 40.

While certain features and embodiments of the invention have been described in detail herein it should be understood alternatives and modifications may be employed without departing from the scope and spirit of the invention as defined by the appended claims.

What is claimed is:

1. A marking device for a shorthand machine comprising:

(a) a housing, said housing having (i) a substantially flat, rectangular base plate having a longitudinal channel extending the length of the base plate, (ii) a substantially flat, rectangular top plate complementary to the base plate and secured to the base plate, and (iii) means maintaining said top plate and said base plate in spaced-apart relationship;

(b) an elongate key having a forward and rearward end;

(c) means for mounting said key for substantially longitudinal movement within said channel between a retracted and an advanced position;

(d) biasing means continuously urging the key toward its retracted position;

(e) means for removably mounting said housing on the shorthand machine;

(f) a marking instrument mounted adjacent the forward end of the key for movement with the key between the retracted and advanced positions; and (g) a finger-engagement means at the rearward end of said key to facilitate manual longitudinal movement of said key between the retracted and advanced positions.

2. A marking device for selectively marking the margin of a paper tape in a shorthand machine of the type having a platen for advancing the paper tape and a keyboard for operating the machine so that information may be recorded by the machine on the paper tape being advanced by the platen, said marking device comprising:

(a) a housing, said housing having (i) a substantially flat, rectangular base plate having a longitudinal channel extending the length of the base plate, (ii) a substantially flat, rectangular top plate complementary to the base plate and secured to the base plate, and (iii) means maintaining said top plate and said base plate in spaced-apart relationship;

(b) an elongate key having a forward and rearward end;

(c) means for mounting said key for longitudinal movement within said channel between a retracted and an advanced position;

(d) biasing means continuously urging the key toward its retracted position;

(e) means for removably mounting said housing on the shorthand machine intermediate the platen and the keyboard with the rearward end of said key disposed adjacent the keyboard when said key is in its retracted position;

(f) a marking instrument mounted adjacent the forward end of the key for movement with the key whereby the marking instrument will be moved into contact with the paper tape when the key is moved to its advanced position for applying a mark on the paper tape; and (g) a finger-engagement means at the rearward end of said key to facilitate manual longitudinal movement of said key between the retracted and advanced positions.

3. A device as in claim 2, wherein said finger-engagement means comprises a finger pad at said rearward end, and a cavity at said forward end, said marking instrument being shaped to be received by said forward cavity in the key.

4. A device as in claim 3, wherein the marking instrument is a disposable cartridge comprising a "U"-shaped holder, the base of the "U" comprising a live hinge for facilitating insertion of the disposable cartridge in and removal of the disposable cartridge from the forward cavity of each elongate key, and a marking element mounted in said holder and positioned for striking the paper tape carried by the platen upon advancement of the key.

5. A device as in claim 4, wherein the marking element comprises an ink-impregnated roller rotatably mounted in the "U"-shaped holder.

6. A device as in claim 2, wherein;

(a) said elongate key is slidable relative to said housing; and (b) said elongate key has said forward end disposed adjacent the platen when the key is in its advanced position.

7. A device as in claim 6, wherein the housing includes a pair of parallel, spaced apart longitudinal channels each being shaped to receive an elongate key and for guiding the marking instruments thereof to strike the mark opposite margins of the paper tape on the platen of the machine when the elongate keys are moved from the fully retracted position to the fully advanced position.

8. A device as in claim 6, wherein said key includes an elongate cavity intermediate its opposite ends, said housing including a resilient dampener mounted in said channel and received by said cavity for engaging and limiting the movement of said key at the extent of its travel.

9. A device as in claim 6, in which said mounting means includes:

(a) said longitudinal channel having therein an upstanding guidepost, the elongate key having a slot therein for receiving said guidepost, whereby the key is maintained in spaced-apart relationship with the base plate and is tracked along a path parallel to said channel; and (b) said key having at least one ridge projecting above the upper edge thereof and engaging the top plate for maintaining the key in proper relationship relative to the top and base plates when the housing is assembled.

10. A device as in claim 9, wherein said guidepost engages said slot adjacent the forward end of the key, and in which said mounting means further includes said base plate having a second upstanding guidepost in each channel, said key having a second slot shaped to receive the second guidepost adjacent the rearward end of the key, said key further including a contact being shaped to engage the channel of the base plate.

11. A device as in claim 9, including biasing means in said channel for engaging and lifting the key therein, ensuring that each ridge on the key is continuously urged into contact with the top plate.

12. A disposable cartridge for use as a marking instrument in a marking device for a shorthand machine of the type having a platen for advancing a paper tape, the marking device having an elongated operating key defining a forward cavity, the disposable cartridge comprising a "U"-shaped holder, the base of the "U" comprising a live hinge for facilitating insertion of the disposable cartridge into and removal of the disposable cartridge from the forward cavity of the elongated operating key, and a marking element mounted in said holder and positioned for striking the paper tape carried by the platen upon advancement of the key.

13. A device as in claim 12, wherein the marking element comprises an ink-impregnated roller rotatably mounted in the "U"-shaped holder.

14. A marking device for a shorthand machine comprising:

a. a housing, said housing having
   (i) a substantially flat, first plate having a longitudinal channel extending the length of the first plate,
   (ii) a substantially flat, second plate complementary to the first plate and secured to the first plate, said second plate constituting a cover for said channel, and
   (iii) means maintaining said first plate and said second plate in spaced-apart relationship;

b. an elongate key having a forward and rearward end;

c. means for mounting said key for substantially longitudinal movement within said channel between a retracted and an advanced position;

d. biasing means continuously urging the key toward its retracted position;

e. means for removably mounting said housing on the shorthand machine;

f. a marking instrument mounted adjacent the forward end of the key for movement with the key between the retracted and advanced positions; and g. a finger-engagement means at the rearward end of said key to facilitate manual longitudinal movement of said key between the retracted and advanced positions.

* * * * *